US012672720B2

(12) United States Patent
Chen

(10) Patent No.: US 12,672,720 B2
(45) Date of Patent: Jul. 7, 2026

(54) FOLDING CHAIR

(71) Applicant: GUANGZHOU GISILI BABY PRODUCTS CO. LIMITED, Guangzhou (CN)

(72) Inventor: Wei Chen, Guangzhou (CN)

(73) Assignee: GUANGZHOU GISILI BABY PRODUCTS CO. LIMITED, Guangzhou (CN)

( * ) Notice: Subject to any disclaimer, the term of this patent is extended or adjusted under 35 U.S.C. 154(b) by 124 days.

(21) Appl. No.: 18/707,604

(22) PCT Filed: Jan. 28, 2022

(86) PCT No.: PCT/CN2022/074461
§ 371 (c)(1),
(2) Date: May 6, 2024

(87) PCT Pub. No.: WO2023/082476
PCT Pub. Date: May 19, 2023

(65) Prior Publication Data

US 2025/0000265 A1 Jan. 2, 2025

(30) Foreign Application Priority Data

Nov. 9, 2021 (CN) ..... 202111320959.X

(51) Int. Cl.
*A47C 4/30* (2006.01)
*A47C 4/38* (2006.01)
(Continued)

(52) U.S. Cl.
CPC ..... *A47C 4/30* (2013.01); *A47C 4/38* (2013.01); *A47C 4/48* (2013.01); *A47C 7/021* (2013.01); *A47C 7/543* (2013.01)

(58) Field of Classification Search
CPC .... A47C 4/30; A47C 4/14; A47C 4/24; A47C 4/38; A47C 4/48; A47C 4/16; A47C 4/26; A47C 7/021; A47C 7/543
(Continued)

(56) References Cited

U.S. PATENT DOCUMENTS 105,472 A * 7/1870 McAleer ..... A47C 4/14 297/38
2,697,476 A * 12/1954 Tripodi ..... A47C 4/30 297/18
(Continued)

FOREIGN PATENT DOCUMENTS

CN 202723195 U 2/2013
CN 113876131 A 1/2022

*Primary Examiner* — Milton Nelson, Jr.

(57) ABSTRACT

A folding chair, comprises a front support, a rear support, a backrest plate, armrest supports, backrest supports, a seat cushion, armrest sleeves, and a front-support sliding frame. The front support is connected to the rear support; each armrest support has one end connected to one end of each backrest support and the other end connected to the rear support; the other end of each backrest support is connected to the front-support sliding frame; the number of the backrest supports is two, and the backrest supports are respectively disposed on both sides of the front-support sliding frame; the backrest plate is provided on the backrest supports; the armrest sleeves are provided on the armrest supports; the seat cushion has one end connected with the rear support and the other end connected with the front-support sliding frame.

10 Claims, 16 Drawing Sheets

(51) Int. Cl.
*A47C 4/48* (2006.01)
*A47C 7/02* (2006.01)
*A47C 7/54* (2006.01)

(58) Field of Classification Search
USPC ..... 297/227
See application file for complete search history.

(56) References Cited

U.S. PATENT DOCUMENTS

| | | | | |
|---|---|---|---|---|
| 4,415,201 | A | 11/1983 | Wang | |
| 5,700,053 | A * | 12/1997 | Downing | A47C 31/11 5/663 |
| 7,328,942 | B1 | 2/2008 | Wu | |
| 8,029,059 | B2 | 10/2011 | Smith et al. | |
| 2010/0001555 | A1* | 1/2010 | Chen | A47C 4/48 297/46 |

* cited by examiner

FOLDING CHAIR

This application claims priority to Chinese Patent Application No. CN202111320959.X, titled "FOLDING CHAIR", filed on Nov. 9, 2021 with the China National Intellectual Property Administration. The content of the aforementioned applications, including any intervening amendments thereto, is incorporated herein by reference.

FIELD

The present disclosure relates to the technical field of multifunctional furniture, in particular to a folding chair, and specifically to a reversing folding chair.

BACKGROUND

A folding chair is indispensable in modern life. At present, there are kinds of folding chairs in the market, and a consumer may select different products based on different environments, seasons and preferences. For example, a folding chair made of warm cotton cloth or flannel is preferred in winter, and a cool mesh fabric or rattan cloth is preferred in summer. Conventionally, replacements of a seat cushion cover, a backrest cover and an armrest cover are completed generally by disassembly and assembly, resulting in low efficiency and poor operability. In addition, the folding chair in the conventional technology only has a folding function, and cannot realize reversing. Therefore, it is necessary to provide a folding chair which solves the problems.

SUMMARY

In view of this, a folding chair is provided according to the present disclosure, in order to solve at least one problem in the conventional technology.

In order to achieve the above objectives, the following technical solutions are provided according to the present disclosure.

According to the present disclosure, a folding chair is provided, which includes a front support, a rear support, a backrest plate, an armrest support, a backrest support, a seat cushion, an armrest sleeve, and a front-support sliding frame. The front support and the rear support are connected with each other. An end of the armrest support is connected with an end of the backrest support, the other end of the armrest support is connected with the rear support, and the other end of the backrest support is connected with the front-support sliding frame. The backrest support is in a quantity of two, the two backrest supports are respectively arranged on two sides of the front-support sliding frame, and the backrest plate is arranged on the backrest supports. The armrest sleeve is arranged on the armrest support. An end of the seat cushion is in shaft connection with the rear support, and the other end of the seat cushion is in shaft connection with the front-support sliding frame. The front-support sliding frame is sleeved inside the front support and is slidable inside the front support.

In a case that a lower end of the front support is located in front of a lower end of the rear support, a first surface of the seat cushion faces upward, a first surface of the backrest plate is opposite to the first surface of the seat cushion and a first surface of the armrest sleeve, and the backrest plate is located behind the seat cushion. In a relative rotation of the front support and the rear support, the front-support sliding frame is driven to slide upward, the backrest support and the armrest support rotate simultaneously, and thereby the lower end of the rear support is located in front of the lower end of the front support. In this case, a second surface of the seat cushion faces upward, a second surface of the backrest plate is opposite to the second surface of the seat cushion and a second surface of the armrest sleeve, and the backrest plate is located behind the seat cushion.

Further, the rear support includes an external support rod, an internal support rod, a connecting rod, and an intermediate cross rod, which are connected with each another. The external support rod is connected to the armrest support. The external support rod, the internal support rod and the connecting rod are connected in a U-shape. The intermediate cross rod is connected to the seat cushion.

Further, the lower end of the front support is configured to rotate from a front side of the lower end of the rear support to a rear side of the lower end of the rear support.

Further, the external support rod of the rear support is located on an outer side of the internal support rod of the rear support.

Further, the backrest support is located on an inner side of the rear support, and the front support is located on an inner side of the backrest support.

Further, the backrest support includes a backrest support body and a backrest sliding frame, where the backrest sliding frame moves along the backrest support body.

Further, the armrest support includes an armrest support body and an armrest sliding frame, where the armrest sliding frame moves along the armrest support body.

Further, the rear support includes a rear support body and a rear support sliding frame, where the rear support sliding frame moves along the rear support body.

Advantages of the present disclosure are as follows.

The folding chair according to the present disclosure has functions of folding and reversing. Switching of a seat cushion surface, a backrest surface, and an armrest surface can be realized by reversing, without disassembly. Therefore, an efficiency of switching is improved.

BRIEF DESCRIPTION OF THE DRAWINGS

For more clearly illustrating embodiments of the present disclosure or technical solutions in the conventional technology, the drawings referred to for describing the embodiments or the conventional technology are briefly described hereinafter. It is apparent that the drawings in the following description are only exemplary. Those of ordinary skill in the art can obtain other implementation drawings from the provided drawings without any creative effort.

Structures, scales, dimensions, and the like as shown in the drawings are drawn in coordination with the contents disclosed in the specification, and are intended to facilitate understanding and apprehending by those familiar with the technology, rather than to limit a condition of implementing the present disclosure. Therefore, the drawn structures, scales, dimensions, and the like, have no actual/real significance in techniques. Any structural modification, change in proportional relationship, or adjustment in dimensions, when not affecting an effect or purpose of embodiments of the present disclosure, shall fall within the scope covered by technical content disclosed herein.

Figure 1:
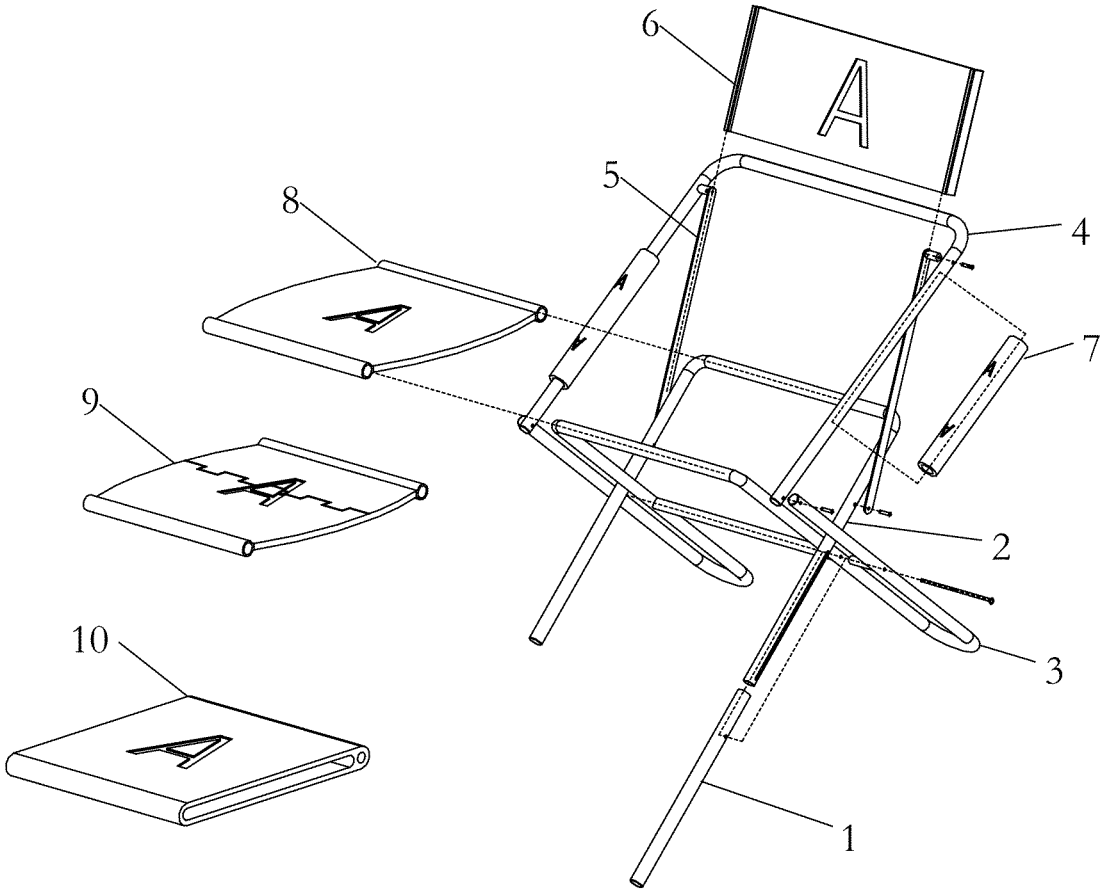
FIG. 1 is a schematic exploded view of a folding chair according to an embodiment of the present disclosure.
Figure 2:
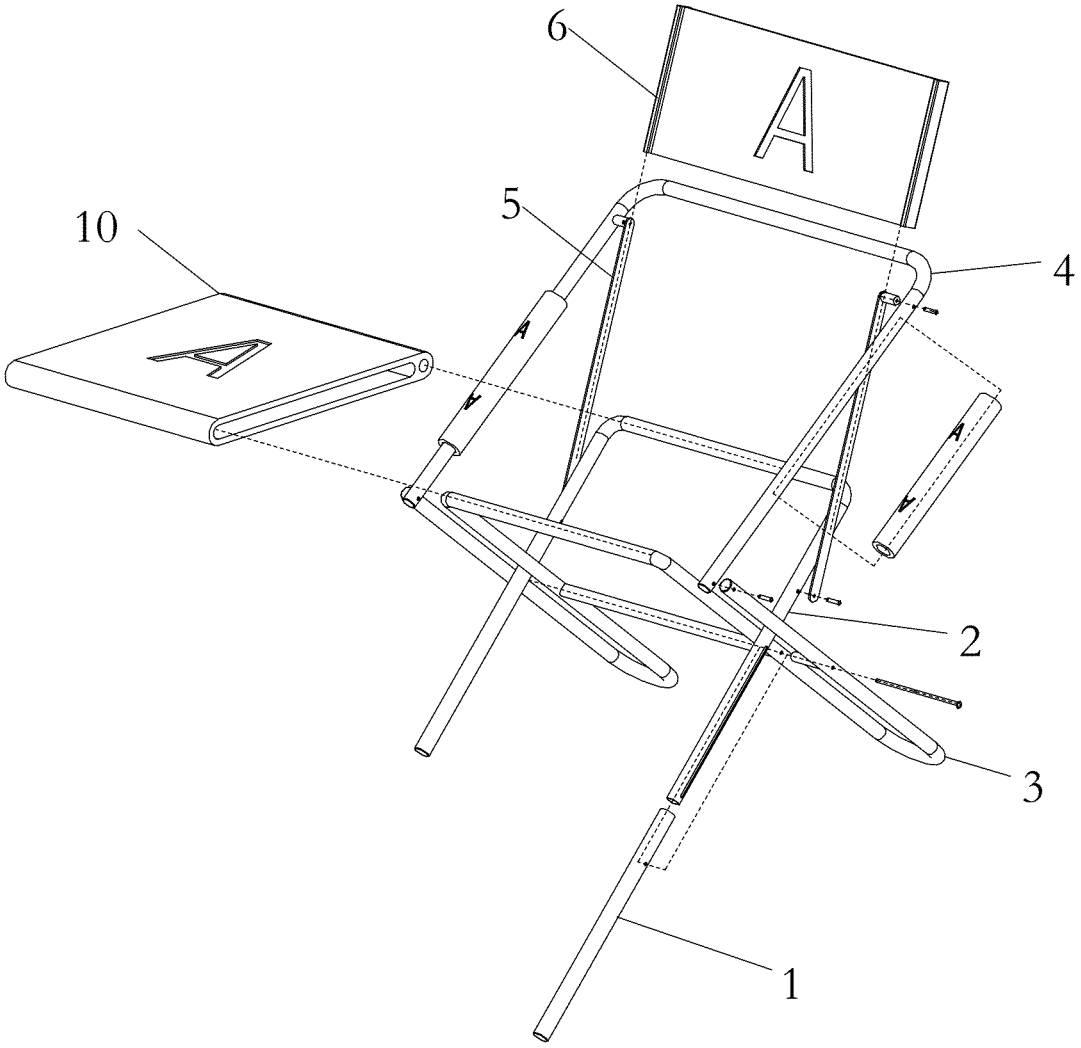
FIG. 2 is a schematic exploded view of a folding chair according to an embodiment of the present disclosure.
Figure 3:
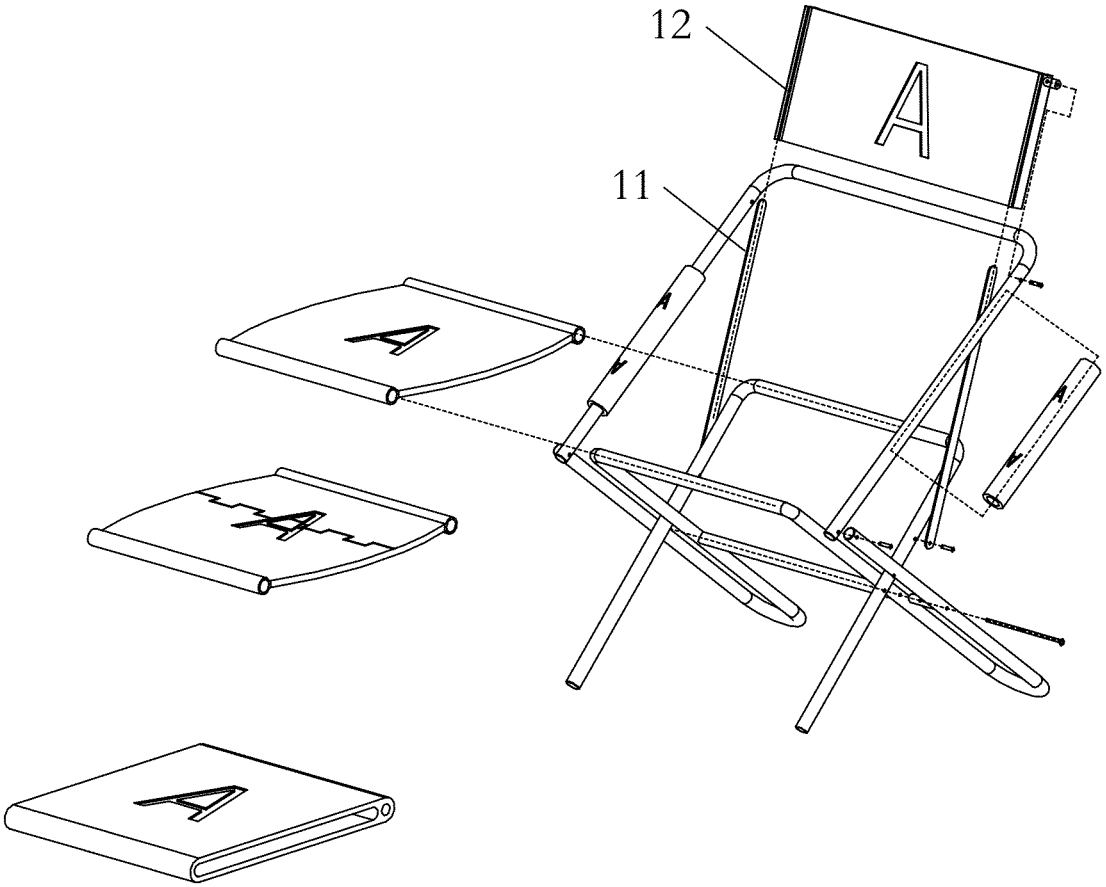
FIG. 3 is a schematic exploded view of a folding chair according to an embodiment of the present disclosure.
Figure 4:
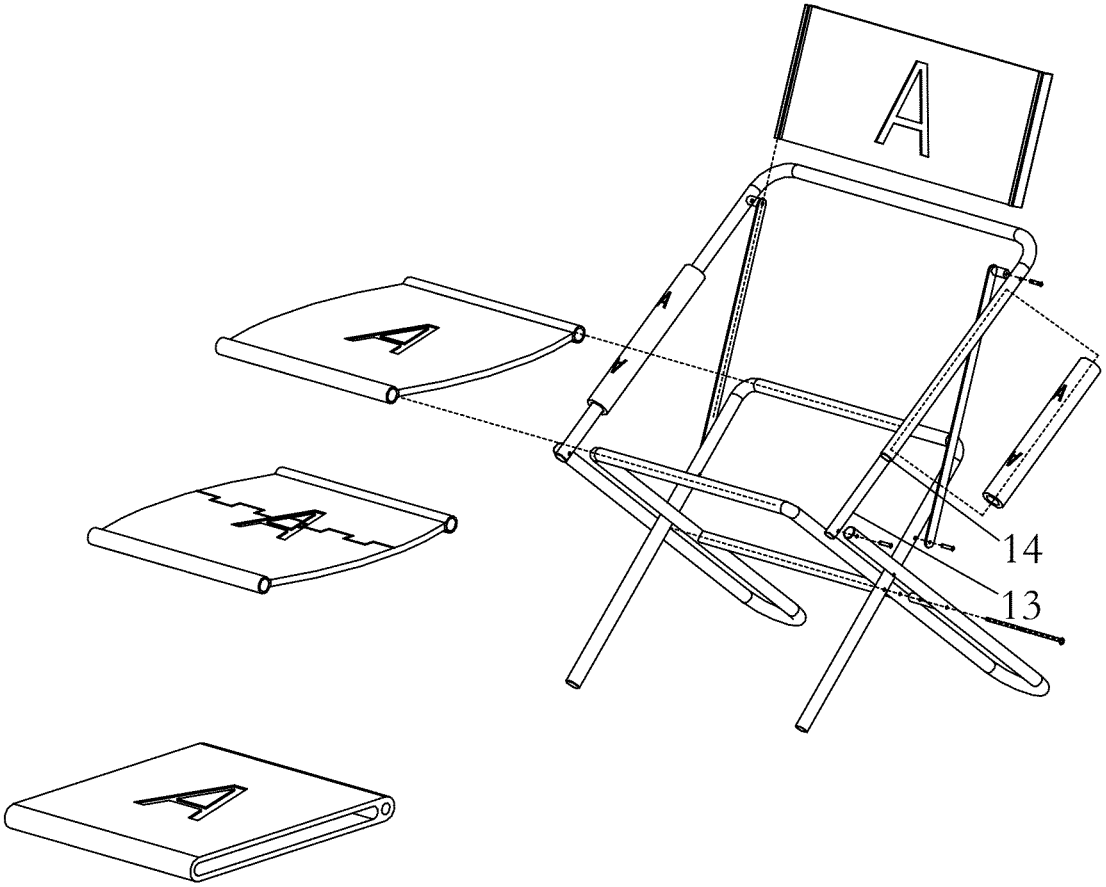
FIG. 4 is a schematic exploded view of a folding chair according to an embodiment of the present disclosure.
Figure 5:
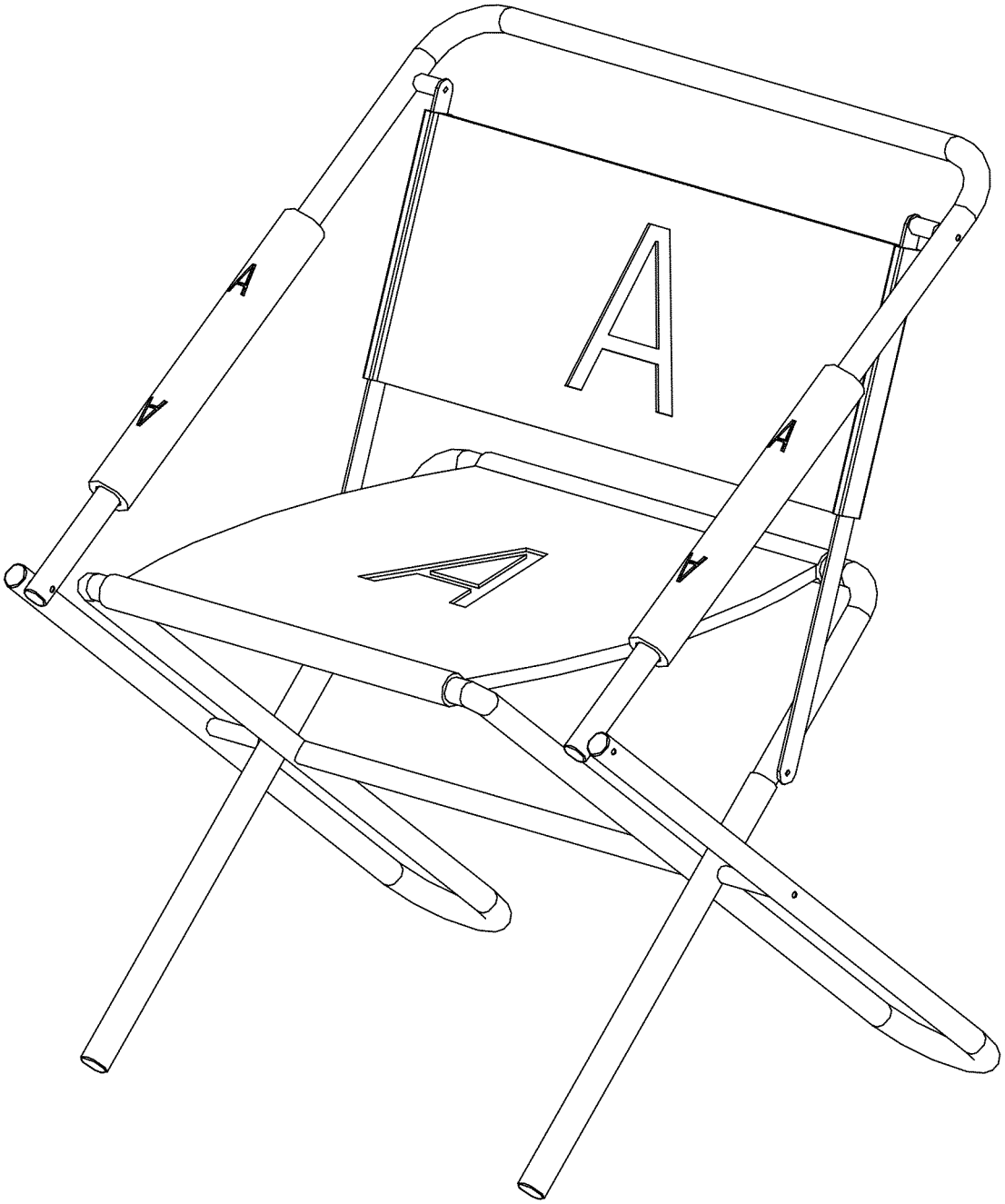
FIG. 5 is a schematic structural view of a folding chair according to an embodiment of the present disclosure.
Figure 6:
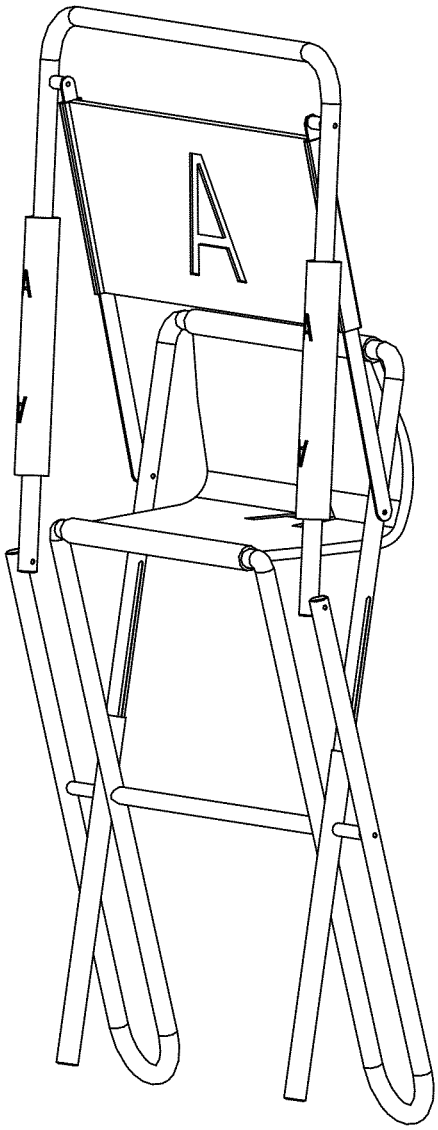
FIG. 6 is a schematic structural view of a folding chair during reversing according to an embodiment of the present disclosure.
Figure 7:
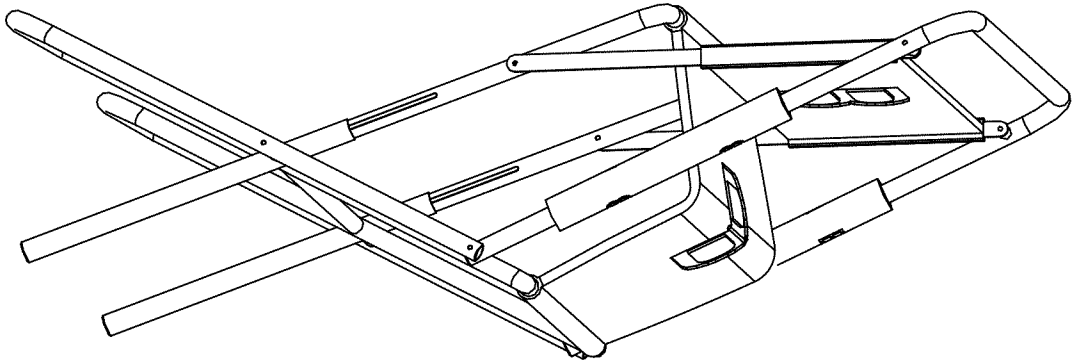
FIG. 7 is a schematic structural view of a folding chair during reversing according to an embodiment of the present disclosure.

Reference numerals in the drawings are listed below.

| | |
|---|---|
| 1 Front support; | 2 Front-support sliding frame; |
| 3 Rear support; | 4 Armrest support; |
| 5 Backrest support; | 6 Backrest plate; |
| 7 Armrest sleeve; | 8 Seat cushion; |
| 9. Hinge seat cushion; | 10 Sliding seat cushion; |
| 11 Backrest sliding frame; | 12 Backrest support body; |
| 13 Armrest sliding frame; | 14 Armrest support body; |
| 15 Rear support sliding frame; | 16 Rear support body; |
| 17 Connecting rod; | 18 Intermediate cross rod; |
| 19 Internal support rod; | 20 External support rod. |

DETAILED DESCRIPTION OF THE EMBODIMENTS

The following specific embodiments illustrate the implementation of the present disclosure. Those familiar with the technology can easily understand the other advantages and effects of the present disclosure from the content disclosed in this specification. It is apparent that the described embodiments are only a part of the embodiments according to the present disclosure, rather than all of the embodiments. All the other embodiments obtained by those skilled in the art based on the embodiments in the present disclosure without any creative work fall within the scope of the present disclosure.

According to an embodiment of the present disclosure, a folding chair is provided. As shown in FIG. 1 to FIG. 16, the folding chair includes a front support 1, a rear support 3, a backrest plate 6, an armrest support 4, a backrest support 5, a seat cushion 8, an armrest sleeve 7, and a front-support sliding frame 2. The front support 1 and the rear support 3 are connected with each other. An end of the armrest support 4 is connected with an end of the backrest support 5, the other end of the armrest support 4 is connected with the rear support 3, an end of the backrest support 5 is connected with the armrest support 4, and the other end of the backrest support 5 is connected with the front-support sliding frame 2. The backrest support 5 is in a quantity of two, the two backrest supports 5 are respectively arranged on two sides of the front-support sliding frame 2, and the backrest plate 6 is arranged on the backrest supports 5. The armrest sleeve 7 is arranged on the armrest support 4, an end of the seat cushion 8 is in shaft connection with the rear support 3, and the other end of the seat cushion 8 is in shaft connection with the front-support sliding frame 2. The front-support sliding frame 2 is sleeved inside the front support 1 and is slidable inside the front support 1.

In a case that a lower end of the front support 1 is located in front of a lower end of the rear support 3, a first surface of the seat cushion 8 faces upward, a first surface of the backrest plate 6 is opposite to the first surface of the seat cushion 8 and a first surface of the armrest sleeve 7, and the backrest plate 6 is located behind the seat cushion 8. In a relative rotation of the front support 1 and the rear support 3, the front-support sliding frame 2 is driven to slide upward, the backrest supports 5 and the armrest support 4 rotate simultaneously, and thereby the lower end of the rear support 3 is located in front of the lower end of the front support 1. In this case, a second surface of the seat cushion 8 faces upward, a second surface of the backrest plate 6 is opposite to the second surface of the seat cushion 8 and a second surface of the armrest sleeve 7, and the backrest plate 6 is located behind the seat cushion 8.

Figure 8:
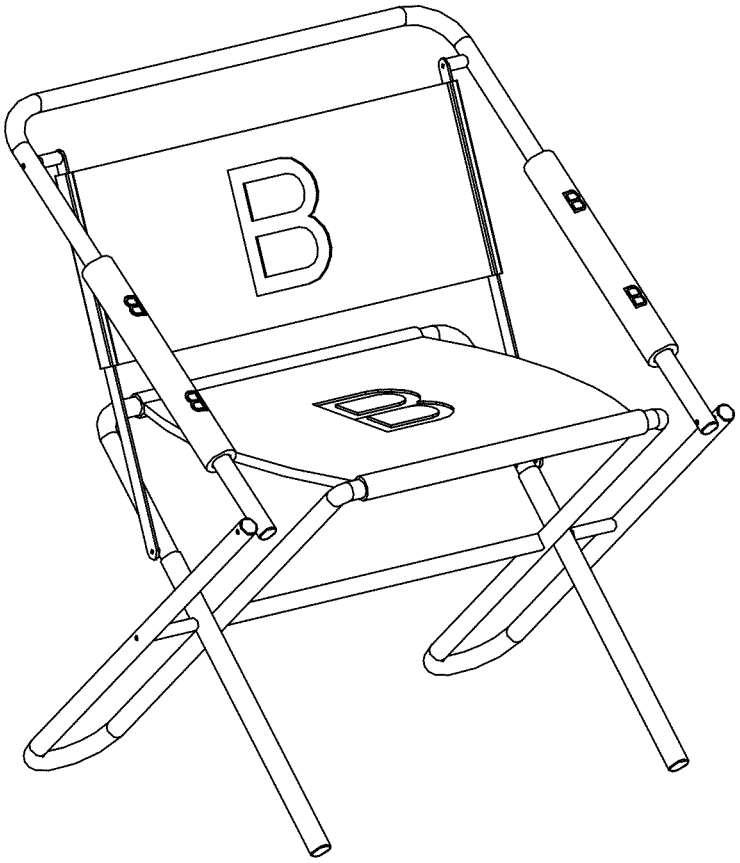
FIG. 8 is a schematic structural view of a folding chair after reversing according to an embodiment of the present disclosure.
Figure 9:
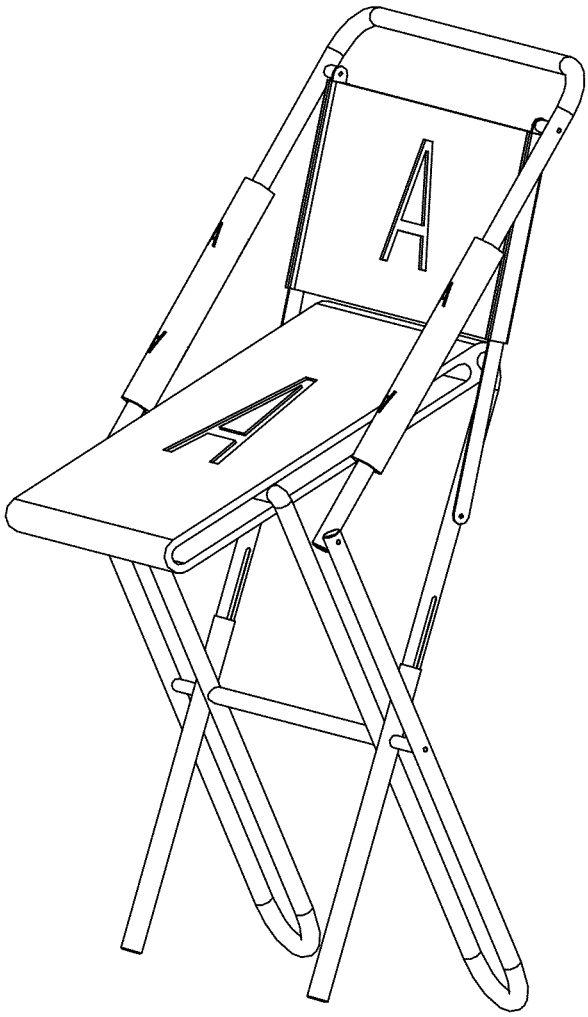
FIG. 9 is a schematic structural view of a sliding seat cushion of a folding chair during reversing according to an embodiment of the present disclosure.
Figure 10:
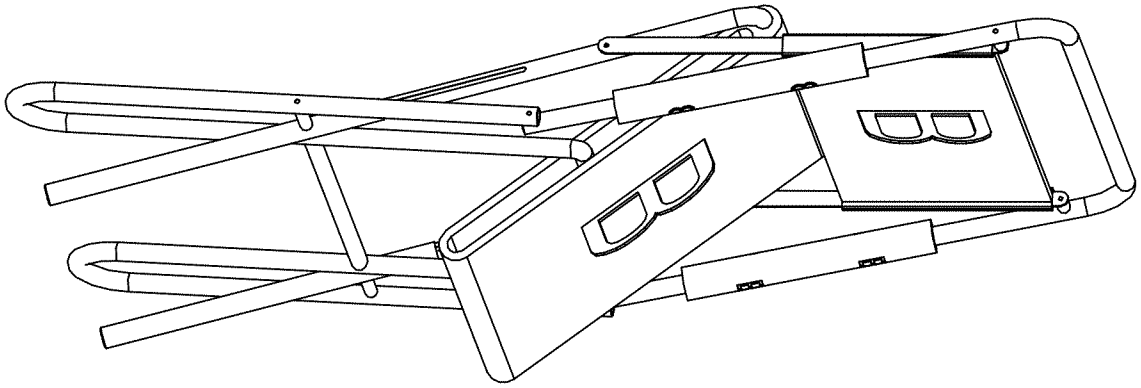
FIG. 10 is a schematic structural view of a sliding seat cushion of a folding chair during reversing according to an embodiment of the present disclosure.
Figure 11:
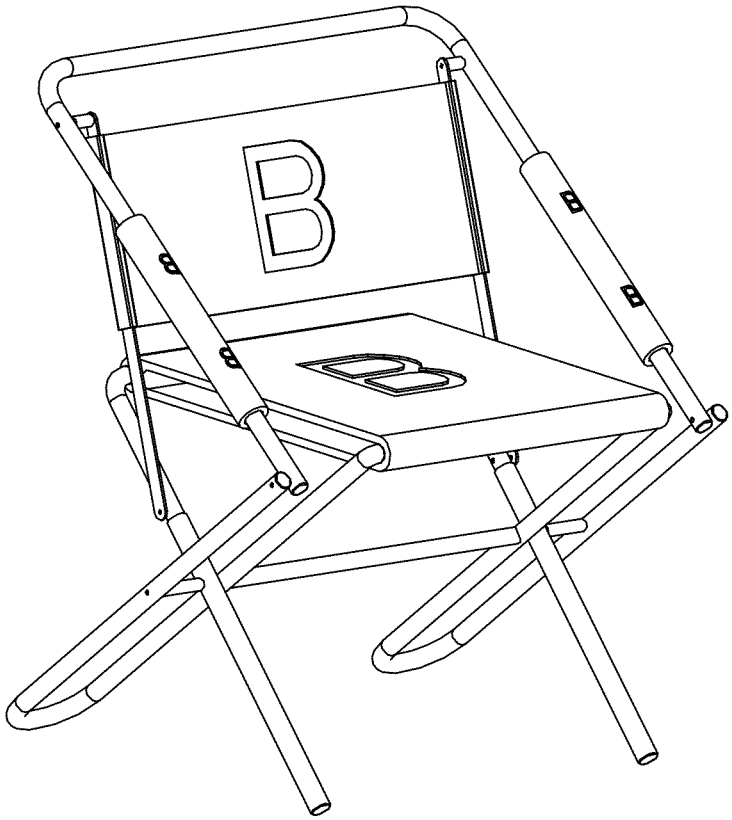
FIG. 11 is a schematic structural view of a sliding seat cushion of a folding chair after reversing according to an embodiment of the present disclosure.
Figure 12:
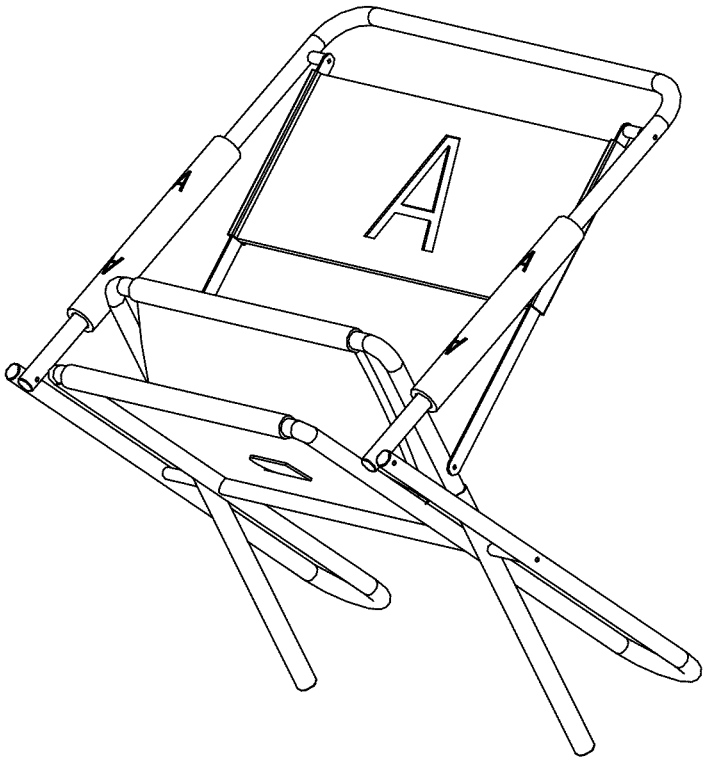
FIG. 12 is a schematic structural view of a folding chair during folding according to an embodiment of the present disclosure.
Figure 13:
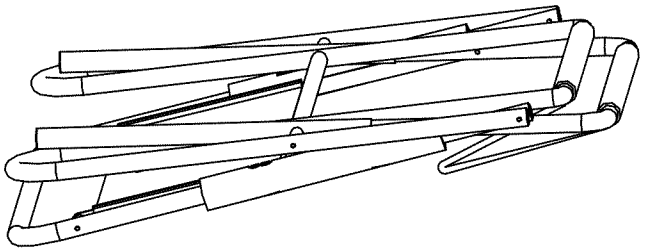
FIG. 13 is a schematic structural view of a folding chair after folding according to an embodiment of the present disclosure.
Figure 14:
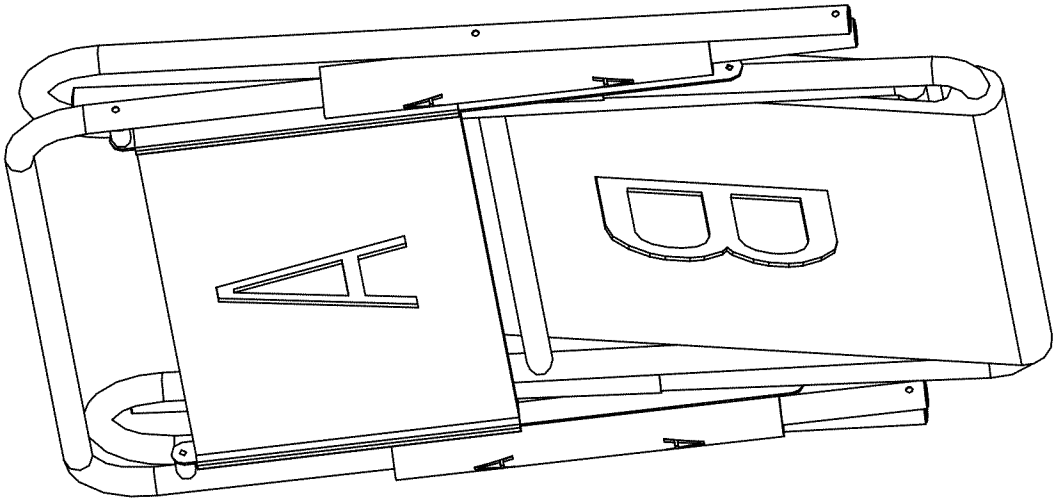
FIG. 14 is a schematic structural view of a folding chair after folding according to an embodiment of the present disclosure.
Figure 15:
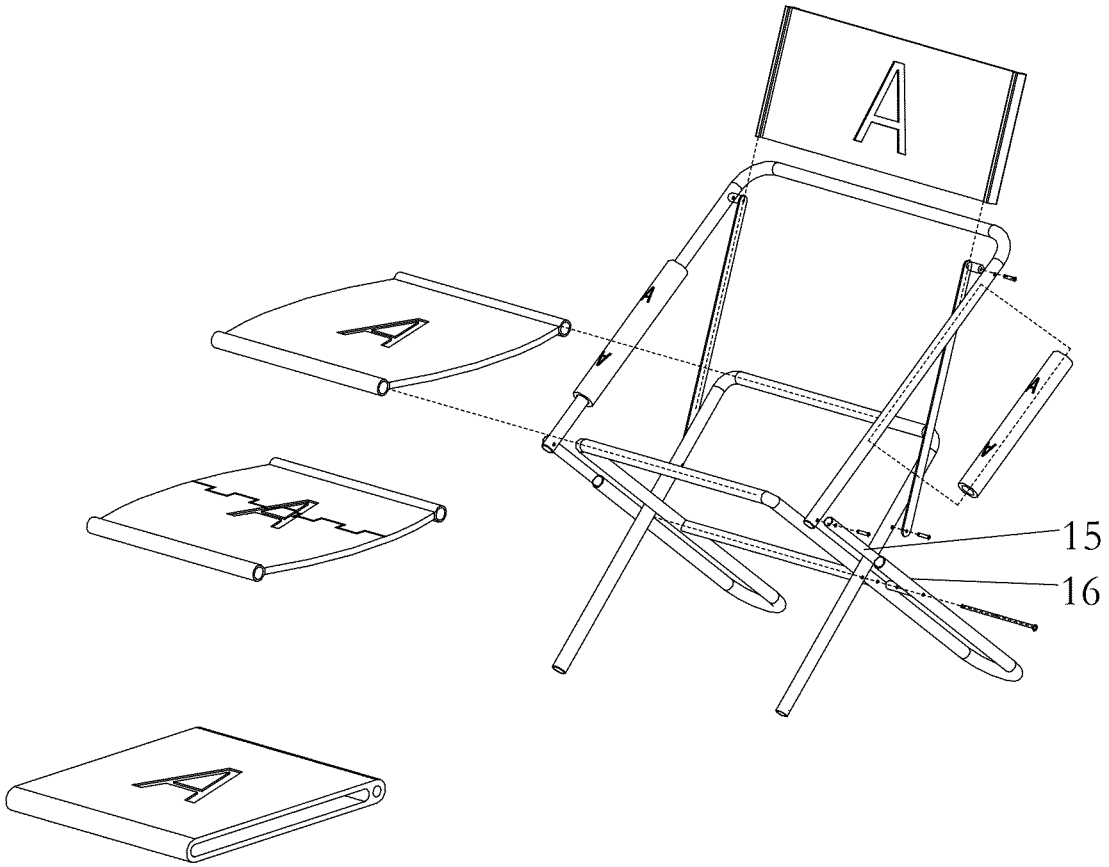
FIG. 15 is a schematic structural view of a folding chair according to an embodiment of the present disclosure.
Figure 16:
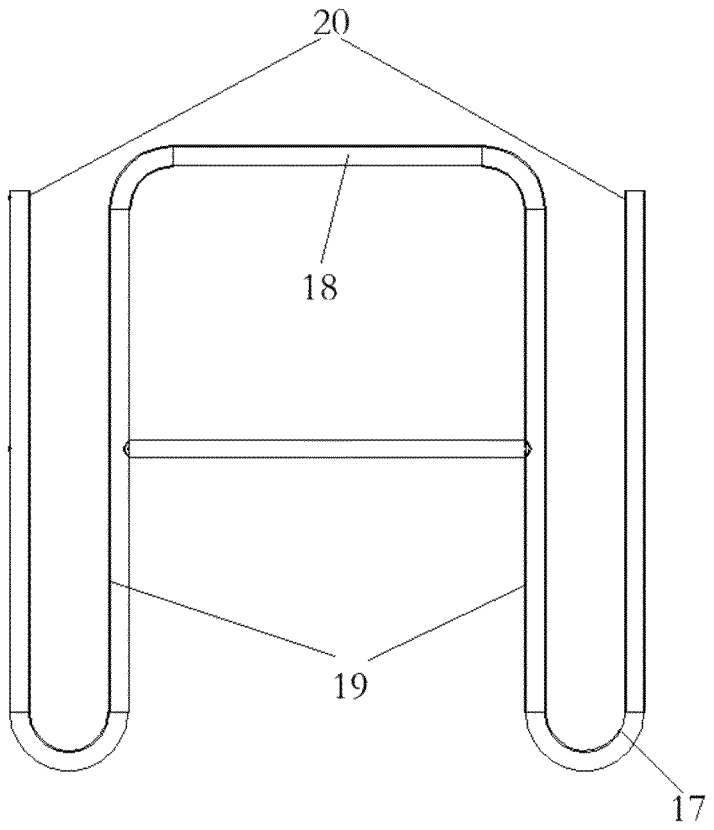
FIG. 16 is a schematic structural view of a rear support according to an embodiment of the present disclosure.

FIG. 1 shows the state in which the lower end of the front support 1 is located in front of the lower end of the rear support 3. FIG. 8 shows the state in which the lower end of the rear support 3 is located in front of the lower end of the front support 1.

The rear support 3 includes an external support rod 20, an internal support rods 19, a connecting rod 17, and an intermediate cross rod 18, which are connected with each another. The external support rod 20 and the internal support rod 19 are connected to the armrest support 4. The external support rod 20, the internal support rod 19 and the connecting rod 17 are connected in a U-shape. The intermediate cross rod 18 is connected to the seat cushion 8.

The front support 1 is located between the external support rod 20 and the internal support rods 19 of the rear support 3.

The lower end of the front support 1 is configured to rotate from a front side of the lower end of the rear support 3 to a rear side of the lower end of the rear support 3. The front side and rear side herein are defined the same as a front position and rear position, respectively.

The external support rod 20 of the rear support 3 is located on an outer side of the internal support rod 19 of the rear support 3. The outer side here refers to a direction away from a center of the seat cushion 8.

The backrest support 5 is located on an inner side of the rear support 3. The front support 1 is located on an inner side of the backrest support 5. The inner side here refers to a direction approaching the center of the seat cushion 8.

By providing one or more seat cushions 8, seat cushions made of different materials are available for a user to choose from as needed and can come to use without disassembly by the user.

The backrest plate 6 is fixed onto the backrest supports 5. An end of the seat cushion 8 is in shaft connection with the front support 1, and the other end of the seat cushion 8 is in shaft connection with the front-support sliding frame 2. The armrest sleeve 7 is fixed on a surface of the armrest support 4. The backrest plate 6, the armrest sleeve 7, a soft seat cushion, a hinge seat cushion 9 or a sliding seat cushion 10 may be made of different materials, for example, half by silicone and the other half by metal, or the like. Through a reversing operation, different contact surfaces can be provided to contact with the skin of the user. For example, a metal surface may be provided to contact with the skin in summer and a silicone surface may be provided to contact with the skin in winter.

An end of the rear support 3 is connected with an end of the armrest support 4 by a rivet, and the other end of the armrest support 4 is connected with the backrest support 5 by a rivet. Apparently, a pin, a bolt, or other connecting means may be adopted for fixation.

The backrest support 5 is connected with an end of the front-support sliding frame 2 by a rivet.

The seat cushion 8 is one or more of the soft seat cushion, the hinge seat cushion 9 or the sliding seat cushion 10. An end of the seat cushion 8 is connected to the intermediate cross rod 18 of the rear support 3, and the other end of the seat cushion 8 is connected to the front-support sliding frame 2. The armrest support includes an armrest support body 14 and an armrest sliding frame 13. The armrest sliding frame 13 moves along the armrest support body 14.

The rear support includes a rear support body 16 and a rear support sliding frame 15. The rear support sliding frame 15 moves along the rear support body 16.

Each backrest support 5 includes a backrest support body 11 and a backrest sliding frame 12. The backrest sliding frame 11 moves along the backrest support body 12.

In actual use, a reversing operation and a folding operation may be performed in different manners, such as reversing between a surface A of the backrest plate and a surface B of the backrest plate, reversing between a surface A of the seat cushion and a surface B of the seat cushion, and reversing between a surface A of the armrest sleeve and a surface B of the armrest sleeve. The user can operate to use different working surfaces as needed, and therefore obtain a more comfortable use experience. The surface A of the seat cushion is the first surface of the seat cushion, the surface A of the backrest plate is the first surface of the backrest plate 6, the surface B of the seat cushion is the second surface of the seat cushion, and the surface B of the backrest plate is the second surface of the backrest plate 6. The armrest sleeve 7 has a first surface and a second surface, and a reversing operation can be performed thereon to change a surface in contact with people.

With the folding chair according to the present disclosure, switching among different seat cushion surfaces, backrest surfaces, and armrest surfaces can be realized through simple reversing operations. Hence, the product is applicable to different environments and adaptable to personal preferences of the user, so that resource saving and waste reduction are realized.

The folding chair according to the present disclosure can be folded or unfolded directly, which is convenient and flexible to use. The folding chair, when folded, occupies little space, and is therefore convenient to carry.

Although the present disclosure is described in detail above with general descriptions and specific embodiments, some modifications or improvements can be made on the basis of the present disclosure, which is apparent to those skilled in the art. Therefore, all those modifications and improvements made without departing from the spirit of the present disclosure fall within the protection scope of the present disclosure.

What is claimed is:

1. A folding chair, comprising a front support, a rear support, a backrest plate, an armrest support, a backrest support, a seat cushion, an armrest sleeve, and a front-support sliding frame, wherein the front support and the rear support are connected with each other;

an end of the armrest support is connected with an end of the backrest support, the other end of the armrest support is connected with the rear support, and the other end of the backrest support is connected with the front-support sliding frame;

the backrest support is in a quantity of two, the two backrest supports are respectively arranged on two sides of the front-support sliding frame, and the backrest plate is arranged on the backrest supports;

the armrest sleeve is arranged on the armrest support;

an end of the seat cushion is in shaft connection with the rear support, and the other end of the seat cushion is in shaft connection with the front-support sliding frame;

the front-support sliding frame is sleeved inside the front support and is slidable inside the front support;

in a case that a lower end of the front support is located in front of a lower end of the rear support, a first surface of the seat cushion faces upward, a first surface of the backrest plate is opposite to the first surface of the seat cushion and a first surface of each armrest sleeve, and the backrest plate is located behind the seat cushion; and in a relative rotation of the front support and the rear support, the front-support sliding frame is driven to slide upward, the backrest support and the armrest support rotate simultaneously, and thereby the lower end of the rear support is located in front of the lower end of the front support, wherein in the case where the lower end of the rear support is located in front of the lower end of the front support, a second surface of the seat cushion faces upward, a second surface of the backrest plate is opposite to the second surface of the seat cushion and a second surface of each armrest sleeve, and the backrest plate is located behind the seat cushion.

2. The folding chair according to claim 1, wherein the rear support comprises an external support rod, an internal support rod, a connecting rod, and an intermediate cross rod, which are connected with each another, the external support rod is connected to the armrest support, the external support rod, the internal support rod and the connecting rod are connected in a U-shape, and the intermediate cross rod is connected to the seat cushion.

3. The folding chair according to claim 2, wherein the front support is located between the external support rod and the internal support rod of the rear support.

4. The folding chair according to claim 2, wherein the lower end of the front support is configured to rotate from a front side of the lower end of the rear support to a rear side of the lower end of the rear support.

5. The folding chair according to claim 2, wherein the external support rod of the rear support is located on an outer side of the internal support rod of the rear support.

6. The folding chair according to claim 5, wherein the backrest support is located on an inner side of the rear support; and the front support is located on an inner side of the backrest support.

7. The folding chair according to claim 1, wherein the backrest support comprises a backrest support body and a backrest sliding frame, and the backrest sliding frame moves along the backrest support body.

8. The folding chair according to claim 1, wherein the armrest support comprises an armrest support body and an armrest sliding frame, and the armrest sliding frame moves along the armrest support body.

9. The folding chair according to claim 1, wherein the rear support comprises a rear support body and a rear support sliding frame, and the rear support sliding frame moves along the rear support body.

10. The folding chair according to claim 1, wherein the seat cushion is one selected from a soft seat cushion, a hinge seat cushion, and a sliding seat cushion.

* * * * *